United States Patent [19]

St. Louis

[11] Patent Number: 4,677,760

[45] Date of Patent: Jul. 7, 1987

[54] DRIER STORABLE RACK

[75] Inventor: Robert M. St. Louis, St. Leonard, Canada

[73] Assignee: Camco Inc., Mississauga, Canada

[21] Appl. No.: 908,169

[22] Filed: Sep. 17, 1986

[30] Foreign Application Priority Data

Oct. 11, 1985 [CA] Canada ..... 492882

[51] Int. Cl.[4] ..... F26B 20/00

[52] U.S. Cl. ..... 34/90; 34/103; 34/104; 34/133; 34/239

[58] Field of Search ..... 34/133, 103, 202, 90, 34/104, 239

[56] References Cited

U.S. PATENT DOCUMENTS

| | | | |
|---|---|---|---|
| 2,628,432 | 2/1953 | Morrison | 34/68 |
| 3,316,659 | 5/1967 | Lauck | 34/133 |
| 3,344,532 | 10/1967 | Bigler | 34/133 |
| 4,091,548 | 5/1978 | Daily | 34/133 |

*Primary Examiner*—Larry I. Schwartz
*Attorney, Agent, or Firm*—Raymond A. Eckersley

[57] ABSTRACT

A conventional clothes drier is provided with a rack structure mounted on the bulkhead that extends into and plugs the access opening to the drum of the drier. The rack is selectively mountable in either an operative extended position projecting cantilever fashion into the drier drum or alternatively in a retracted or storing position wherein the rack is contained within the bulkhead.

10 Claims, 8 Drawing Figures

DRIER STORABLE RACK

FIELD OF THE INVENTION

The present invention relates to a rack for a domestic tumble drier, more particularly the present invention relates to a rack mountable on the bulkhead of the door in either an extended position projecting into the drum of the drier or alternatively in a storing position contained within the bulkhead.

BACKGROUND OF THE PRESENT INVENTION

Many domestic driers are sold with a rack that can be mounted through the access opening and project from the opening either across or through the drum of the drier. Many such racks are mounted by simply hanging from the door on one side and hanging from the axle of rotation on the other side of the drum so that the rack extends axially of the drum but remains in a fixed position without rotating relative to the drum.

It is also known to cantileverly mount a rack from a fixed rear wall of the drier in driers where the drum itself it more a sleeve rather than an open ended drum i.e. the back wall is not part of the drum. In this arrangement the rack is cantilevered from the fixed back wall and projects toward the access opening and provides a fixed rack onto which materials such as boots or the like may be placed for drying.

Obviously with either of the above structures when the drier is used in its conventional form for drying clothes using a tumbling action the rack must be retracted from its operative position and stored somewhere outside of the drier. This normally means finding a shelf or some other place to store the rack while it is not in use. As a result the use of such racks is relatively limited as there is not always a convenient storage place adjacent the drier and use of the rack is an extra chore.

BRIEF DESCRIPTION OF THE INVENTION

It is an object of the present invention to provide a rack for a domestic tumble drier that may be stored within the drier itself and be easily accessible for use.

Broadly the present invention relates to a clothes drier comprising a housing, a rotatable drum mounted to rotate within the housing, heater means; means for circulating air heated by said heater means through said drum, an access passage to said drum for loading of said drier, a door closing said access passage and having a bulkhead projecting into said passage thereby to block off said passage, rack means, means for mounting said rack means on said door in an operative position projecting cantilever fashion from said door into said drier drum or in a stored position where said rack is contained by said bulkhead within said access passage.

Preferably said bulkhead will be provided with socket means adapted to receive mounting projecting portions of said rack member to mount said rack member in cantilever fashion from said socket means when said portions are retained therein.

Preferably said rack means will comprise at least one substantially U-shaped member, having a pair of legs interconnected by a bridging portion, mounting sockets in said bulkhead opening toward said drier drum when the door is closed and into which the ends of said legs are received to mount said U-shaped member in operative position, said bulkhead being substantially hollow and provided with a pair of apertures for each said U-shaped member, said legs of said U-shaped member being receivable through said apertures into the bulkhead which is substantially hollow and said bridging portion of said U-shaped member resting on a top wall of said bulkhead when said U-shaped member has its legs projecting through said apertures and said rack is in stored position.

If desired two pairs of sockets one pair substantially perpendicular to the first pair of sockets may be provided in said bulkhead adjacent the front face thereof whereby said mounting portions may be received within one of said pair of cavities to mount said rack in substantially flush position against the front face of said bulkhead within a cavity formed on the front face of said bulkhead to provide for storage of said rack.

It is also possible to pivotably mount the rack to said bulkhead for movement to an extended operative position contained within said drum and a retracted position wherein said rack is received within a cavity formed by the front face of said bulkhead.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
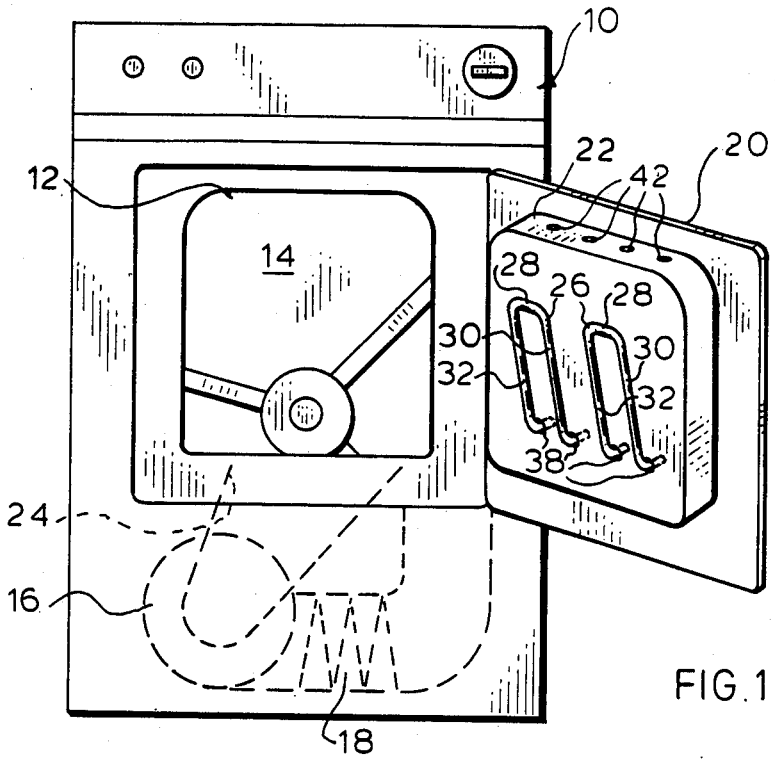
FIG. 1 shows a drier incorporating the present invention with some of the working elements shown by hidden lines.

As illustrated in FIG. 1 the present invention is applied to a drier generally indicated at 10 having an access passage 12 through which the clothes to be dried are inserted into the drum 14. Hot air is circulated to and from the drum via the fan generally indicated at 16 and is heated by the heater 18 in the duct leading to the drum 14.

The access opening 12 is closed via a door 20 which has a bulkhead 22 built thereon and adapted to plug the access passage 12 so that clothes being tumbled within the drier drum 14 do not fall into the access passage 12. In the illustrated arrangement the inlet passage 24 to the fan 16 (exhaust from the drum) is formed on the bottom wall of the passage 12.

Figure 2:
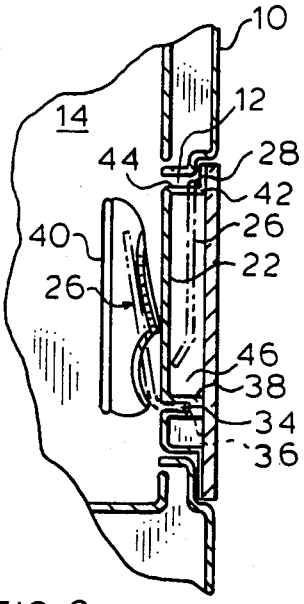
FIG. 2 is an end view of the door of FIG. 1 illustrating two modes of mounting the rack.

In the embodiment illustrated in FIGS. 1 and 2 a pair of racks 26 have been shown. Each of these racks 26 comprises a substantially U-shaped member having a bridging section 28 interconnecting a pair of legs 30 and 32 the ends of which are bent at an obtuse angle to provide mounting portions 34 and 36 respectively.

The bulkhead 22 is provided with mounting holes or sockets generally indicated at 38 (see FIG. 2) there being one socket 38 for each of the mounting portions 34 and 36 of each of the racks 26 as shown in FIG. 2. The portions 34 and 36 are received in their respective sockets 38 so that the legs 30 and 32 extend in cantilever fashion inward from the bulkhead to be received in the drum 14 when the door 20 is in closed position as illustrated in FIG. 2. In the arrangement illustrated a boot or shoe 40 has been shown mounted on the rack 26.

When it is desired to store the rack, the rack is taken from the mounting sockets 38 and the portions 34 and 36 are passed through suitable apertures 42 in the top wall 44 of the bulkhead 22 into the hollow interior 46 of the bulkhead 22 so that the whole of the rack 26 with the exception of the bridging section 28 passes into the hollow interior 46 of the bulkhead 22 where the rack may be stored until it is desired to use it. When it is desired to use the rack it is withdrawn by pulling on the bridging section 28 to lift the rack 26 from the interior of the bulkhead 22 and the portions 34 and 36 inserted to the appropriate sockets 38 to mount the rack 26 in operative position as shown in FIG. 1 and in solid lines in FIG. 2.

Figure 3:
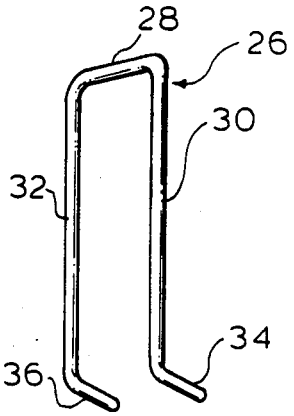
FIG. 3 is a view of the rack per se illustrated in FIGS. 1 and 2.
Figure 4:
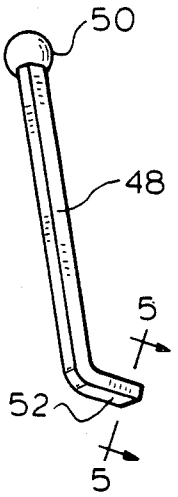
FIG. 4 is a modified rack consisting only of a single pin.
Figure 5:
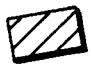
FIG. 5 is a section along line 5—5 of FIG. 4.

Racks other than the U-shaped rack shown in FIGS. 1 to 3 may be used. For example, a simple spike or pin or the like 48 having a rounded head 50 and a mounting portion or foot 52 extending at an obtuse angle from the shank of the spike 48 as shown in FIG. 4 may be used with suitable modification of the mounting sockets 38 in place of the racks 26. At least the mounting portion or foot 52 of the spike type rack 48 will have a rectangular cross-section or other non-circular cross-section such as that shown for example in FIG. 5. Thus the sockets 38 instead of being circular in cross-section will have a cross-section to match with the cross-section of the foot 52 of the spike 48 so that the spike when mounted in position will not rotate but will be fixed preferably in a substantially vertical plane extending substantially perpendicular to the door 20.

Figure 6:
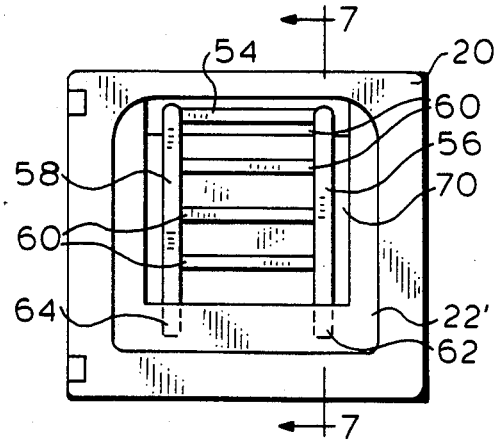
FIG. 6 is front view of the inner face of a door constructed in accordance with the present invention and incorporating a different type of rack.
Figure 7:
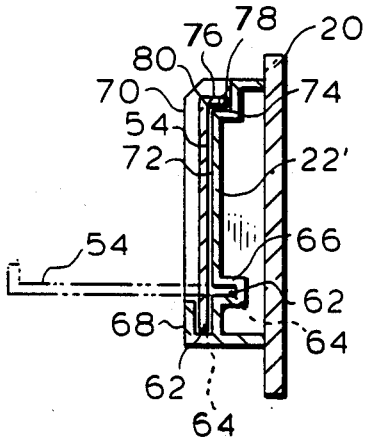
FIG. 7 is a section along the line 7—7 of FIG. 6 illustrating the manner in which the rack of FIG. 6 may be stored.
Figure 8:
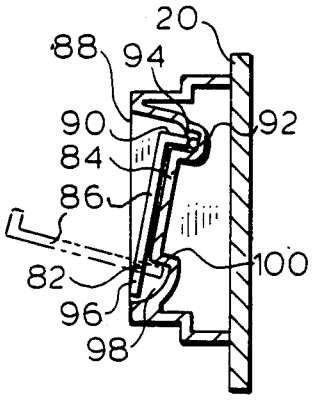
FIG. 8 shows a modified version of a mounting of a rack similar to that shown in FIGS. 6 and 7.

If a more complicated rack is desired the embodiments of FIGS. 6 to 8 inclusive may be employed. Obviously these racks will add significantly to the costs.

As shown in FIG. 6 the rack 54 is composed of a pair of side rails 56 and 58 interconnected by a plurality of rungs or the like 60 to form an open floor. Each of the side rails 56 and 58 is provided with an extension or mounting portion or foot 62 and 64 respectively each adapted to be received within its respective substantially horizontally oriented socket 66 (see FIG. 7) formed in the hollow bulkhead 22' when the rack 54 is in extended operative position as shown in dotted lines in FIGS. 7 or in its respective substantially vertically oriented socket 68 when the rack 54 is in stored position.

It will be noted that the bulkhead 22' is provided with cavity 70 into which the rack 54 is received when it is in stored position. Preferably the inner wall 72 of the cavity 70 will be sloped from the vertical i.e. towards the door 20 and the upper wall 74 of the cavity will be sloped at an angle downward toward the door 20. Preferably a lip 76 will be formed at the free end of the rack 54 i.e. the end remote from the feet 62 and 64 and will extend at an angle to the body of the rack 54 such that its free end 78 is positioned below the junction 80 of the walls 72 and 74 of the cavity 70 thereby to lock the end or lip 76 to the bulkhead 22' when the feet 62 and 64 are received within the cavities 68 and the rack 54 is stored position as shown in FIG. 7. The sockets 68 will be oriented to properly position the rack 54 in the cavity 70 when the feet 62, 64 are received therein.

The embodiment shown in FIG. 8 is similar to that shown in FIGS. 6 and 7 and will incorporate a similar rack. However, instead of the rack being mounted using a pin and socket arrangement and being completely removable from the bulkhead the rack in this particular case is pivoted on pivot pins such as those illustrated at 82 i.e. there would be one such pivot pin at each side of the rack and the pivot pin will be received within a suitable bearing aperture formed within the molded bulkhead 84. With this arrangement the rack schematically illustrated at 86 is pivotably movable from a stored position wherein it is received within a cavity 88 formed in the front face of the bulkhead 84 and rests at an angle to the vertical to an operative extended position projecting cantilever fashion from the bulkhead 84. A lip 90 formed at the free end of the rack 86 is received in a socket or the like 92 formed in the hollow bulkhead 84 and provided with a suitable resilient detent mean 94 which co-operates with the lip 90 to hold the rack 86 when in stored position. By positioning the rack at an angle sloped toward the door when in stored position gravity helps to maintain the rack in stored position. When the rack is to be used the rack is grasped and pivoted around the pivot pins 82 so that the projecting portion or portions 96 which may simply be equivalent to the legs 62 and 64 of the FIGS. 6 and 7 are each moved within a suitable cavity 98 until the projection 96 contacts the upper wall 100 of the cavity 98 which prevents further movement around the pivot axis 82 and holds the rack 86 in extended operative position wherein it can carry the articles to be dried.

Having described the invention modifications will be evident to those skilled in the art without departing from the spirit of the invention as defined in the appended claims.

What I claim as new and desire to secure by Letters Patent of the United States is:

1. A clothes drier comprising:

a housing;

a rotatable drum mounted to rotate in said housing;

heater means;

means for circulating air heated by said heater means through said drum;

an access passage to said drum;

a door closing said access passage and having a bulkhead projecting into said passage to close off said passage;

rack means selectively movable between an operative position within said drum and a stored, non-operative, position;

means for mounting said rack means on said bulkhead in said operative position, said means for mounting said rack means on said bulkhead including means forming part of said bulkhead for anchoring said rack means to said bulkhead to project inwardly in a cantilever fashion into said drier drum; and, means for holding said rack means in said stored non-operative position wherein said rack means is contained by said bulkhead within said access passage.

2. A drier as defined in claim 1 wherein said rack means is provided with a mounting portion means and wherein said anchoring means comprises a socket into which said mounting portion means is received to mount said rack means in said operative position.

3. A drier as defined in claim 1 wherein said rack means is a substantially U-shaped member having a pair of legs each terminating in a mounting portion and connected together by a bridging section wherein said anchoring means comprises a pair of spaced sockets each one of which is adapted to receive one of said mounting portions to mount said rack means in operative position, and wherein said bulkhead includes a pair of apertures in which said mounting portions and said legs may pass, said aperture being provided through an upper wall of said bulkhead and said bulkhead being hollow so that said legs and their attached mounting portions may pass through said apertures to the inside of said bulkhead with said bridging section extending between said apertures and resting on said upper wall when said rack means is in said stored, non-operative, position.

4. A drier as defined in claim 1 wherein said rack means comprises a spike member having a head and a mounting foot and wherein said anchoring means comprises a socket adapted to receive said mounting foot and prevent rotation of said rack when said rack means is in said operative position.

5. A drier as defined in claim 1 wherein said rack means has an open floor, said means for mounting comprises mounting foot means extending from said rack means, said anchoring means comprises a first co-operating socket means formed in said bulkhead and adapted to receive said mounting foot means to mount said rack means in operative position, and said means for holding comprises a second pair of co-operating socket means oriented substantially perpendicular to said first pair of socket means adapted to receive said mounting foot means to mount said rack means in said stored, non-operative, position, said bulkhead being provided with a cavity formed in the face of said bulkhead facing into said drum when said door closes said access passage, said cavity being adapted to receive said rack means when said rack means is in said stored, non-operative, position.

6. A drier as defined in claim 5 wherein said rack means is provided with a lip at the end thereof remote from said mounting foot means and wherein said lip is received in an undercut portion of said cavity when said rack means is in said stored, non-operative, position.

7. A drier as defined in claim 6 wherein said open floor of said rack means slopes upwardly and towards said door when said rack means is in said stored, non-operative, position.

8. A drier as defined in claim 1 wherein said rack means comprises an open floor and wherein said anchoring means comprises, means pivotally mounting said rack means to said bulkhead adjacent the bottom portion of said bulkhead and one end of said rack means, a cavity formed in the face of said bulkhead facing toward said drier drum when said door is in closed position closing said access passage, said rack means being mounted to be received within said cavity and positioned with said open floor sloping upwardly and towards said door when said rack is in said stored, non-operative, position.

9. A drier as defined in claim 8 further comprising detent means for holding said rack means within said cavity when said rack means is in said stored, non-operative, position.

10. A drier as defined in claim 9 wherein said rack means further comprises projecting portion means extending from said rack means on the side of said means for pivotally mounting remote from the remainder of said rack means, said cavity in said bulkhead adapted to accommodate said projecting portion means, said cavity having an abutment wall means against which said projection means abuts to hold said rack means in operative position when the remainder of said rack means is retracted from said cavity and said rack means is in said operative position.

* * * * *